US005651301A

United States Patent [19]

Thoma et al.

[11] Patent Number: 5,651,301

[45] Date of Patent: Jul. 29, 1997

[54] HYDROSTATIC PISTON MACHINES

[75] Inventors: Christian Helmut Thoma; Arthur Atholl Blair; George Duncan McRae Arnold, all of Jersey, Channel Islands

[73] Assignee: Unipat Aktiengessellschaft, Glarus, Switzerland

[21] Appl. No.: 564,446

[22] Filed: Nov. 29, 1995

[30] Foreign Application Priority Data

Dec. 13, 1994 [GB] United Kingdom ..... 9425384
Jun. 6, 1995 [WO] WIPO ..... PCT/GB95/01302

[51] Int. Cl.[6] ..... F04B 1/06

[52] U.S. Cl. ..... 91/491; 91/497; 417/219; 417/273

[58] Field of Search ..... 417/218, 219, 417/273; 91/491, 497

[56] References Cited

U.S. PATENT DOCUMENTS

| | | | |
|---|---|---|---|
| 1,250,170 | 12/1917 | Hele-Shaw et al. . | |
| 1,656,544 | 11/1928 | Thoma . | |
| 2,646,754 | 7/1953 | Overbeke . | |
| 2,807,140 | 9/1957 | Tyler . | |
| 3,010,405 | 11/1961 | Tomell . | |
| 3,750,533 | 8/1973 | Thoma . | |
| 4,091,717 | 5/1978 | Bojas et al. . | |
| 5,081,907 | 1/1992 | Nagel et al. . | |
| 5,239,827 | 8/1993 | Havens . | |
| 5,249,512 | 10/1993 | Christenson | 91/497 |
| 5,503,535 | 4/1996 | Thoma et al. | 417/219 |

FOREIGN PATENT DOCUMENTS

| | | | |
|---|---|---|---|
| 149819 | 3/1980 | Germany . | |
| 2925236 | 1/1981 | Germany | 417/218 |
| 524199 | 8/1940 | United Kingdom . | |
| 524384 | 8/1940 | United Kingdom | 417/219 |
| 730094 | 5/1955 | United Kingdom . | |

*Primary Examiner*—Charles G. Freay
*Attorney, Agent, or Firm*—Young & Thompson

[57] ABSTRACT

A radial piston hydrostatic machine having an outer housing structure comprising at least two housing elements connectable together along a parting-plane arranged perpendicular to the rotational axis of said drive-shaft to define an internal chamber, a drive-shaft supported in the housing to drive the cylinder-barrel, the cylinder-barrel having a number of radial cylinders, each cylinder containing a piston such that the pistons can bear on the track-ring, fixed abutment means in the housing and disposed radially adjacent the track-ring for resisting the action of the pistons on the track-ring and suppressing vibration emanating from the track-ring.

30 Claims, 6 Drawing Sheets

HYDROSTATIC PISTON MACHINES

FIELD OF THE INVENTION

This invention relates to positive displacement rotary reciprocating piston machines of the type where the displacement of a piston within a cylinder causes fluid to be displaced within that cylinder. Priority is claimed from GB Patent Application No. 9425384.6 filed Dec. 13, 1994 and International patent Application No. PCT/GB95/01302 filed Jun. 6, 1995.

For purposes of definition, a hydrostatic piston machine of the radial piston variety can either be of the type where a rotary cylinder-barrel is mounted for rotation on a ported pintle-valve or where the cylinder-barrel is mounted for rotation on a revolving shaft. In the second type, a stationary axial distributor valve-plate is fluidly connected to the cylinder-barrel to act as the means for porting the individual cylinders.

In the type of radial piston machine employing a pintle-valve, the cylinder-barrel mounted for rotation about its longitudinal axis, and where the cylinder-barrel is provided with a series of generally radial cylinder-bores. Each cylinder-bore contains a piston and each piston is operatively connected to the surrounding annular track-ring. The annular track-ring may be set into an eccentric positional relationship with respect to the rotating axis of the machine to determine the amount of piston stroke. The arcuate-slots in the pintle-valve are arranged to communicate through passages connecting with fluid inlet and outlet conduits attached to the exterior of the machine, and thus rotary movement of the cylinder-barrel is accompanied by radial displacement of the pistons and corresponding displacement of fluid through these conduits. The control-system of the machine operates in determining the required degree of eccentricity required between the track-ring and the central axis of the drive-shaft for the piston stroke, so that the demands of a hydraulic system or circuit can be satisfied. The control-system thereby acts to regulate the supply of hydraulic fluid output from the hydrostatic machine to meet the varying fluid demands of the hydraulic system or circuit.

Known radial piston machines presently available in the market for high-pressure operation have a number of disadvantages that the present invention overcomes.

Some of the known disadvantages are as follows: Excessive radial dimensions due to bulky externally attached control-valves as shown in Gunther Nagel's U.S. Pat. No. 5,081,907; high control effort required to move the track-ring into position and difficulties restraining the noise and vibration emanating from the track-ring; concentration of piston induced loads on the track-ring into localised areas in the housing; difficulties in assembly due to the heat-shrink fit of the pintle-valve into the housing.

In the general construction of prior art radial piston machines, the impulses incident to the operation of the machine and any vibration thereof resulting from these impulses are generally confined to the track-ring itself and which normally become transmitted directly to the housing by the associated connections in-between.

Both Bojas (U.S. Pat. No. 4,091,717) with his hydraulic vibration reducing shoe and Havens (U.S. Pat. No. 5,239,827) with his pre-set mechanical restraining device are clear attempts at overcoming this problem. However, in both cases, the vibration restraining device operates analogous to a mechanical clamp acting on the end faces of the track-ring, and which as a result, impede the operation of the track-ring. As a consequence, the required effort to effect movement or change in the eccentric position of the track-ring is much higher with the result that larger sized hydraulic-rams are needed. The friction at the interface with the track-ring associated with such prior restraining devices detracts from the normally fast rate of piston stroke adjustment and response which is generally recognized as one of the main advantages of the radial piston machines. What is now required, is a track-ring that remains unimpeded in its ability to move fast in response to changing flow requirements in the high-pressure hydraulic circuit, allowing the use of smaller sized actuating means, and without the attendant noise and vibration sometimes associated with prior radial piston machines.

SUMMARY OF THE INVENTION

From one aspect the invention consists of a radial piston hydrostatic machine with a housing having a drive-shaft comprising: at least two housing elements connectable together along a parting-plane arranged perpendicular to the rotational axis of the drive-shaft to define an internal chamber, a cylinder-barrel disposed within the chamber and drivingly connected to the drive-shaft, the cylinder-barrel having a plurality of cylinders, a piston disposed within each of the cylinders, an annular track-ring surrounding the cylinder-barrel such that the pistons can bear on the track-ring, the track-ring being mounted for pivotal movement in a radial plane about an eccentric axis parallel to the axis of rotation of the drive-shaft, fixed abutment means in the housing and disposed radially adjacent the track-ring for resisting the action of the pistons on the track-ring.

For a radial piston machine to operate for many hours successfully and uninterrupted at pressures in the order of magnitude of 350 bar, it is important that the housing structure be made sufficiently strong, and an object of the present invention is to improve the means whereby the internally generated pressure loads can be more evenly distributed into the housing structure.

It is certainly well known by those familiar with the art that reciprocating piston machines can be extremely noisy in operation, and that sometimes certain components of these machines vibrate quite violently. The number of pistons and cylinders employed and the speed of rotation of the drive-shaft may be varied considerably but in a typical case wherein 9 cylinders are used and the speed of rotation is 1,500 rev/min there are 13,500 successive impulses or fluid pressure periods per minute or 225 impulses per second. Since the pressure applied to the fluid or liquid used may be as much as 350 bar or even more on occasion, the machine components are stressed in rapid succession. The amplitude of the resulting strains is small due to the rigidity of construction and although the strained members are of rather small area, there is still much resulting vibration by the track-ring. The surrounding housing which frequently serves as a resonator which receives the impulses or vibrations of the device from the track-ring and amplifies the same, producing objectionable sounds and noises. One of the objects of the invention is to reduce or eliminate sounds or noises incident to the high-pressure operation of the hydrostatic machine.

Another object of the invention is to provide an abutment means or abutment-member having a vibration absorbing surface whereby the cyclic variation of the direction of the forces generated by the pistons is used to good effect by urging the track-ring against the vibration absorbing surface without binding, and thereby effect a substantial reduction in track-ring vibration.

It is another object of the invention to simplify and improve the housing construction of the machine whereby the control mechanism for positioning and controlling the track-ring can be incorporated more effectively with the housing in order to achieve a more compact machine design.

It is another object of the invention to incorporate means whereby the effort required to move the track-ring can be reduced, thereby allowing smaller sized hydraulic-rams or struts to be used than would normally be the case.

It is another object of the invention to simplify and improve the assembly practice for the machine.

Although the three embodiments of the invention described and illustrated are for the pintle-valve type of radial piston machine, the principles can also be applied with similar advantage to the axial distributor-valve type of radial piston machine, defined herein as equivalent fluid distribution means. Furthermore, although two of the embodiments shown have two hydraulic-rams to effect displacement of the track-ring, the machine may be adapted to use only a single hydraulic-ram. Mechanically controlled machines employing springs or strut members or having manually adjustable track-rings are also covered within the scope of the specification and claims. These and other objects of the invention will be apparent from reading the specification and referring to the embodiments illustrated.

BRIEF DESCRIPTION OF THE DRAWINGS

The invention may be performed in various ways and three specific embodiments over the conventional art are now described by way of example with reference to the accompanying drawings, in which.

Figure 1:
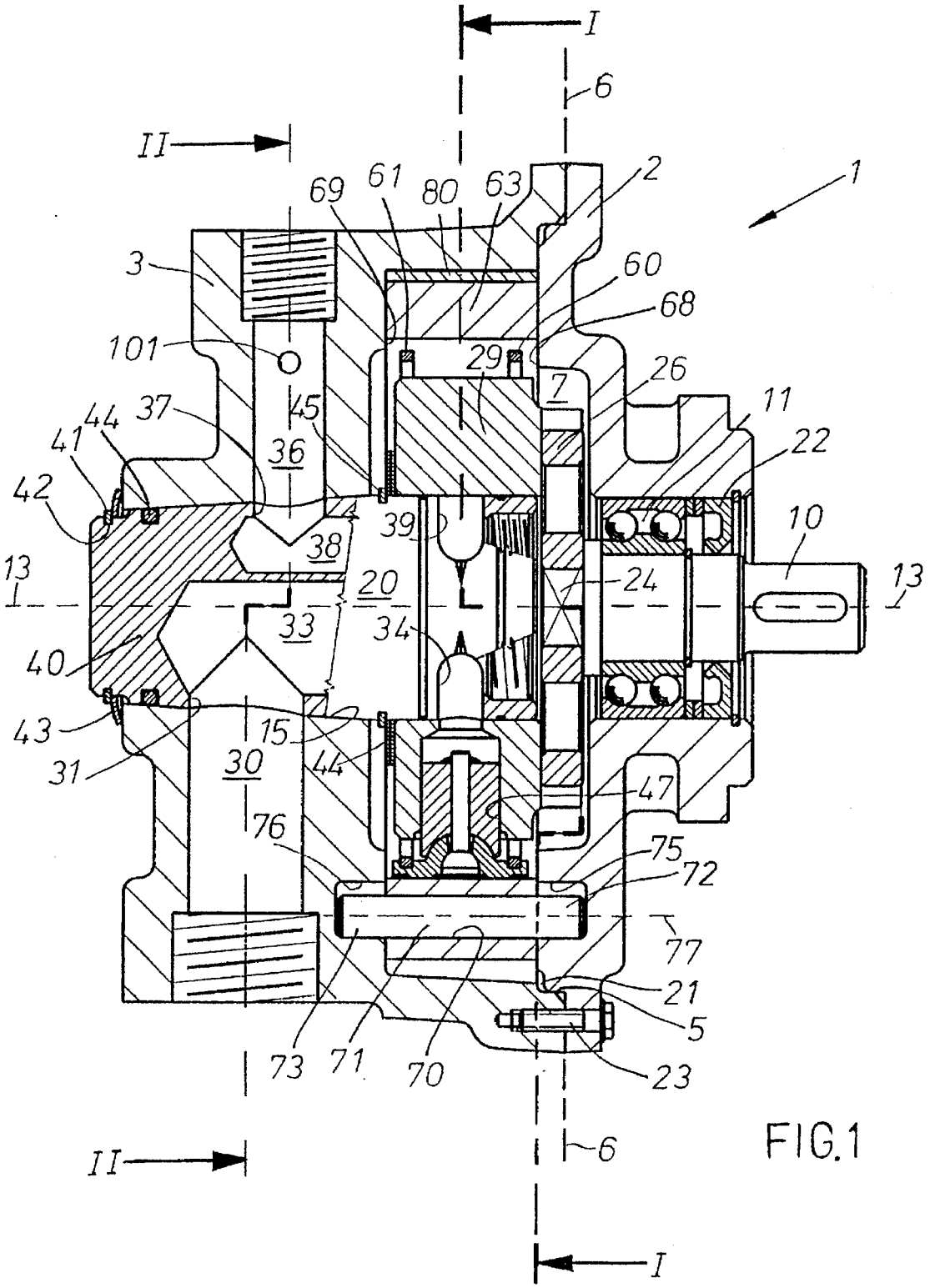
FIG. 1 is a sectional plan view of the hydrostatic radial piston machine according to the invention.
Figure 2:
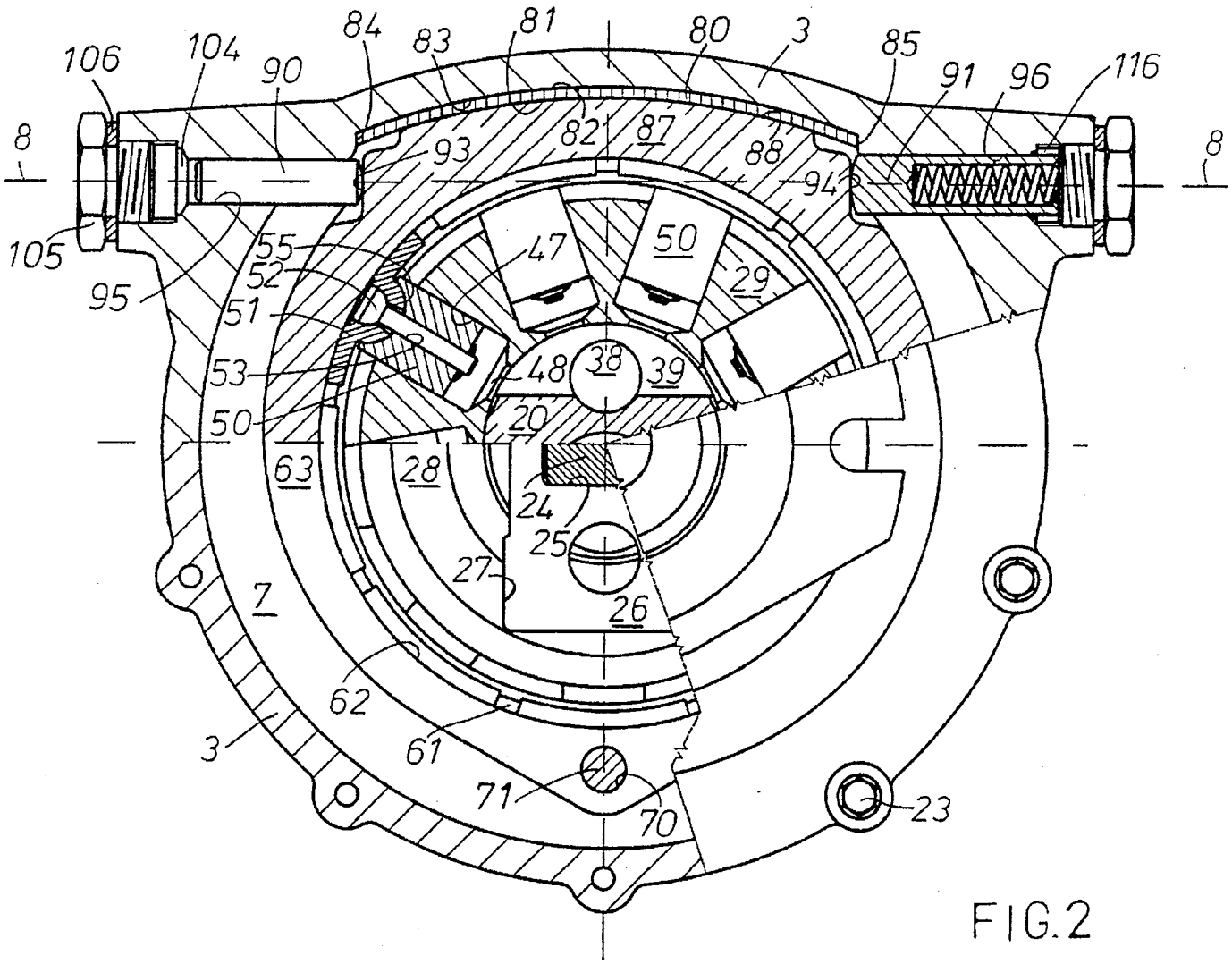
FIG. 2 is a sectional end view of the machine of FIG. 1 on the line I—I.
Figure 3:
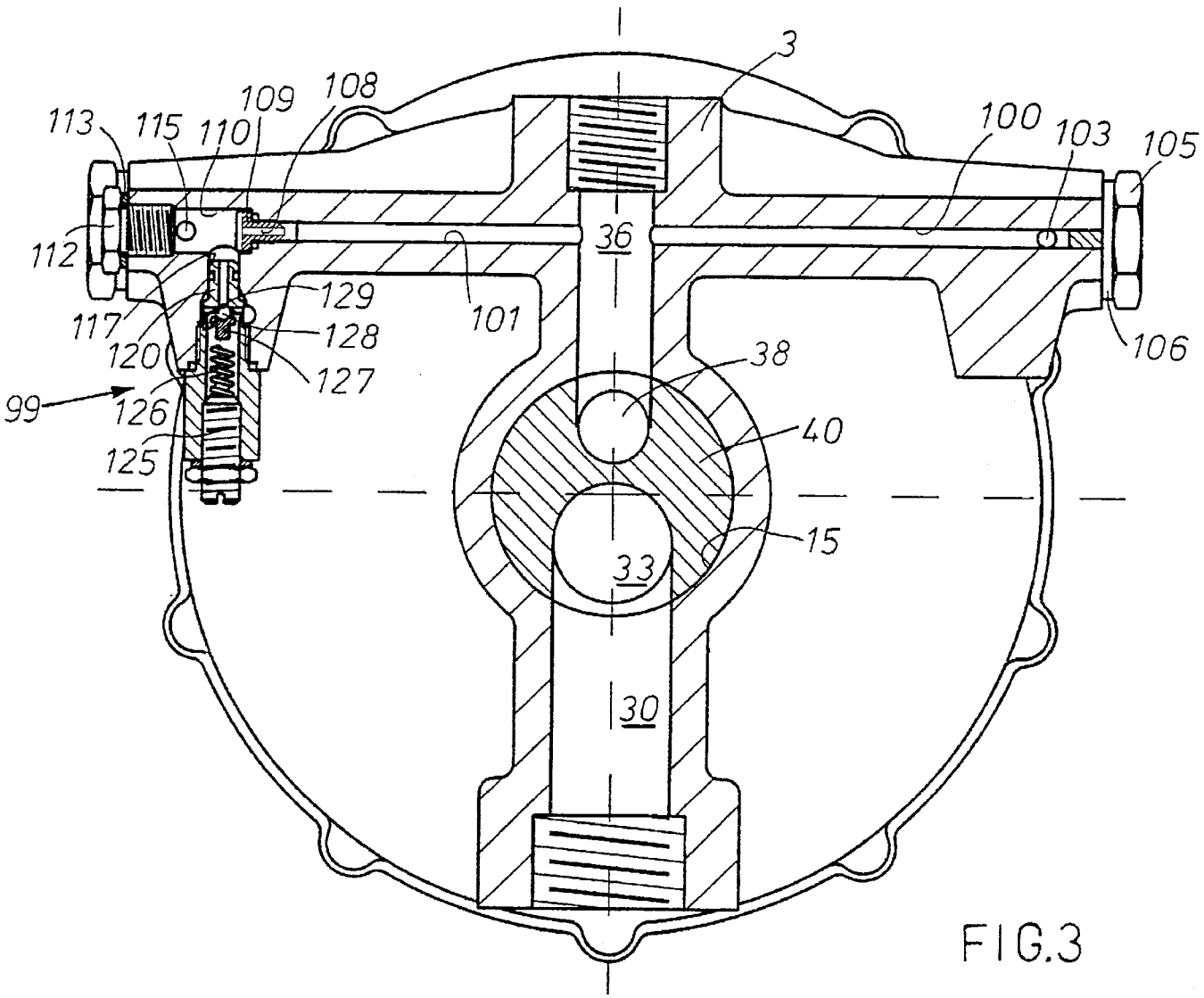
FIG. 3 is a sectional end view of the machine of FIG. 2 on line II—II.

In the first embodiment of the invention as shown in FIGS. 1–3, the hydrostatic machine 1 has a conventional type of housing structure comprising two or more broadly cylindrical housing elements 2, 3 which fit together on a register 5 along a parting-plane 6 arranged between them to define an internal chamber 7. The invention proposes to position the hydraulic-ram or rams as near as possible to the centre of the machine. Therefore, hydraulic-rams 90, 91 are positioned along an axis shown as dotted line 8 which when extended towards each other will actually intersect the circle defining the inside diameter or annular surface 62 of the track-ring 63. With the hydraulic-rams 90, 91 in this position, a circular registration 5 for locating the housing elements 2, 3 in correct radial alignment can be used, and the abutment means 80 can lie inside the dimension of the circular register 5. Housing element 2 is provided with a central aperture 9 into which a rotary drive-shaft 10 is supported by means of bearing 11, and where the parting-plane 6 is arranged perpendicular to the rotational axis 13 of the drive-shaft 10. Housing element 3 is provided with a central tapered aperture 15 into which a pintle-valve 20 is fixedly supported. An "0" ring type seal 21 adjacent said register 5 and rotary-seal 22 adjacent bearing 11 prevents fluid within chamber 7 from escaping, and bolts 23 hold both housing elements 2, 3 together.

A tongue 24 provided on drive-shaft 10 fits into a corresponding slot 25 provided in an "oldham" type misalignment coupling 26. The coupling 26 fits into a slot 27 provided on the end face 28 of the cylinder-barrel 29.

A low-pressure fluid admittance passageway 30 for the machine 1 is provided in housing element 3, which is arranged to connect by means of a pintle-slot 31 provided in the pintle-valve 20 to an internal longitudinal-passage 33 and where passage 33 connects with arcuate-slot 34.

Similarly, a high-pressure fluid discharge passageway 36 for the machine 1 is provided in housing element 3, which is arranged to connect by means of a pintle-slot 37 provided in the pintle-valve 20 to internal longitudinal-passage 38, and where passage 38 connects with arcuate-slot 39.

One problem faced during the construction and assembly of prior radial piston machines of the type shown in U.S. Pat. No. 5,081,907 occurs when the pintle-valve is inserted into the housing element by means of a heat shrink fit. This is not only difficult to perform, but in case of error, both expensive parts have to be replaced. In the machine of the present invention, this difficulty is overcome by having a taper at the interface between the shank end portion 40 of pintle-valve 20 and the associated aperture 15 provided in the housing element 3. Application of a sealing and retaining solution product such as the trade marked "Loctite 638" results in a leak-free interface surrounding respective pairs of pintle-slots 31, 37 and passageways 30, 36. A circlip 41 fitted into groove 42 retains one or more disc springs 43 in place between the protruding portion of shank end 40 and housing element 3, and thereby, pintle-valve 20 is fixed axially within the aperture 15. As a further insurance against fluid leakage, an "0" ring seal 44 may be used, the advantage being that because the "0" ring 44 is located in the tapered portion on shank end 40, it cannot become damaged during assembly. Assembly of the pintle-valve 20 to the housing element 3 is now a comparatively simple task, as no heat shrink fit is now required. Once the sealant has been applied on the shank-end 40 of pintle-valve 20, the pintle-valve 20 can be carefully and accurately positioned within aperture 15 before the disc spring 43 is located and retained by circlip 41 in groove 42.

A pair of thrust-washers 45 and circlip 46 located near the mid-section of the pintle-valve 20 act in positioning the cylinder-barrel 29 axially in one direction.

The cylinder-barrel 29 is supported for rotation on the pintle-valve 20 and includes a number of cylinder-bores 47 each connected through a respective "necked" cylinder-port 48 to allow fluid distribution between each of the cylinder-bores 47 and the respective pair of arcuate-slots 34, 39 formed on the periphery of the pintle-valve 20.

Each cylinder-bore 47 contains a piston 50 which is attached to a respective slipper 51 by means of a rivet 52. The longitudinal or shank portion of the rivet 52 is a relatively close fit inside an axial longitudinal hole 53 provided in the piston 50, so allowing the required amount of pressurized fluid to bleed from the cylinder-bore 47 to reach the bearing-face of the slipper 51 for the creation of a hydrostatic bearing in a manner well know in the art. Pistons 50 and slippers 51 mate together on a part-spherical socket 55 to allow articulation of the slipper 51 on the piston 50. Guidance-rings 60, 61 are provided and serve to keep the slippers 51 in close proximity with the annular surface 62 of the track-ring 63. Each of the guidance-rings 60, 61 are axially retained in respective grooves 65, 66 provided on the slipper 51, and thus the guidance-rings 60, 61 are preventing from making contact with the adjacent interior walls 68, 69 of the respective housing elements 2, 3.

In this embodiment, the track-ring 63 is provided with a hole 70 into which is fitted a location-pin 71, the location-pin 71 being extended to protrude from the hole 70 in order that both its ends 72, 73 engage with slots 75, 76 provided in each of the housing elements 2, 3. As a result, location-pin 71 is allowed to slide or roll along one axis in a direction transverse to the rotational axis of the machine 1. The longitudinal axis of location-pin 71 is thus the eccentric axis, shown as dotted line 77 for the machine 1.

Abutment means in the form of a part-cylindrical surface that may either be formed directly on the interior of the housing element, or as a separate part called the abutment-member located in the housing interior. In either case, the abutment means is used to resist the radial movement of the track-ring caused by the urge from those pistons experiencing fluid under pressure. A more detailed description of the abutment means can be found in our co-pending International Patent Application No. PCT/GB95/01302.

The abutment means shown in the form of abutment-member 80 is provided with a concave first part-cylindrical bearing surface 81 and a part-cylindrical outer surface 82 which is located in recess 83 provided in housing element 3 and constrained by wall 84, 85 on each side. The recess 83 may be flat or preferably of part-cylindrical profile as illustrated. Track-ring 63 is provided with an outwardly radially extended portion 87 defining a convex second part-cylindrical bearing surface 88.

When pressurized fluid is present in arcuate-slot 39, the general direction of forces from the working pistons 50 of the machine 1 as they act through their respective slippers 51 against the annular surface 62 of the track-ring 63, cause the abutment surfaces comprising concave first part-cylindrical bearing surface 81 and convex second part-cylindrical bearing surface 88 to be urged together without seizing due to the cyclic variation in the direction of the piston forces. This occurs, as location-pin 71 can travel a short distance along along slots 75, 76 allowing the track-ring 63 to make a small radial adjustment in position.

Prototype tests have shown that the use of such abutment means greatly minimizes the disturbance created by the pistons on the track-ring, and as a consequence, much smaller diameter hydraulic-rams can be used than are normally possible. This has great advantage towards at least one of the aims of the invention which is to keep the outer dimensions of the machine as small as possible.

Track-ring 63 of the machine 1 is actuated by hydraulic-rams 90, 91, and where hydraulic-rams 90, 91 slide in respective bores 95, 96. As shown in FIG. 2, the radially extended portion 87 of the track-ring 63 has surfaces 93, 94 to which a respective hydraulic-ram 90, 91 is operatively connected to. Although not shown, the ends of the hydraulic-rams 90, 91 may be fitted with shoes, and where the shoes, which may be hydrostatically lubricated, are arranged to articulate about the longitudinal axis of the hydraulic-rams to compensate for the angular misalignment that occurs as the track-ring 63 is moved into an eccentric relationship relative to the axis of rotation 13 of the machine 1. The hydraulic rams being dimensioned to be not more than 49% the size of one of said pistons.

Positioning the hydraulic-rams such that they slide in cylinders provided in the housing-element has the advantage that the open ends of the cylinders on the exterior surface of the housing elements can be simply closed by use of a threaded plugs and seal-washers. As a consequence, the prior system whereby separate control-blocks were mounted to the exterior face of the machine housing is avoided, with a consequent saving in the important radial dimension of the machine.

Feeder-passages 100, 101 are provided in housing element 3. Feeder-passage 100 is connected to passage 103 which leads into cylinder 104 behind smaller hydraulic-ram 90. Plug 105 and seal 106 close off the cylinder 104. Feeder passage 101 connects through an orifice 108 in the throttle-valve 109 to chamber 110. Plug 112 and seal 113 close chamber 110, and passage 115 leads from chamber 110 to cylinder 116 behind larger hydraulic-ram 91. A further passage 117 connects chamber 110 to an cartridge-valve indicated as 99 which as shown in this embodiment comprises a relief-valve 120 which when "open", releases fluid from chamber 110 into a return passage (not visible) to the internal chamber 7 of the machine 1. An adjustment-screw 125 is provided in housing element 3 so that the tension of the spring 126 of relief-valve 120 can be changed. The spring 126 is guided on a shoe 127 which presses ball 128 against seat 129.

Operation of the Machine

The operation of the machine I is as follows: Rotation of drive-shaft 10 causes cylinder-barrel 29 to rotate about the pintle-valve 20. If track-ring 63 is set in an eccentric relationship to the axis of rotation 13, outward sliding movement of the pistons 50 in their respective cylinder-bores 47 is obtained, such that fluid from some external source, such as a hydraulic reservoir, is drawn in through the low-pressure fluid admittance passageway 30 and passes pintle-slot 31, longitudinal-passageway 33, arcuate-slot 34 to the interior of cylinder-bore 47 via "necked" cylinder-port 48. As the piston 50 returns inwards in its cylinder-bore 47, the fluid is expelled from the interior of cylinder-bore 47 via "necked" cylinder-port 48 into the opposite arcuate-slot 39 from where it is directed along longitudinal-passageway 38 to reach the high-pressure fluid discharge passageway 36 from where it may be piped to service a hydraulic circuit, such as a hydraulic motor. During periods when the ball 128 remains pressed against seat 129 by spring 126, the pressurized fluid in both cylinders 104,116, remains at the same level. As hydraulic-ram 91 (down-stream of the throttle-valve 109) is greater in area than hydraulic-ram 90, the larger hydraulic-ram 91 produces a greater force on the track-ring 63 than the smaller hydraulic-ram 90, the track-ring 63 is held thereby in an eccentric relationship to the axis of rotation 13 of the machine 1.

Once the level of pressurized fluid under the ball 128 at the seat 129 has become sufficiently high to produce a force that compresses spring 126, the ball 128 "lifts" off its seat 129 and the level of pressure in cylinder 116 falls. This causes the force from the smaller hydraulic-ram 90 (which remains at a higher pressure due to the throttle 109) to be greater than the force produced by the larger hydraulic-ram 91, and as a consequence, the eccentric position of the track-ring 63 is reduced with respect to the axis of rotation 13 of the machine 1.

Figure 4:
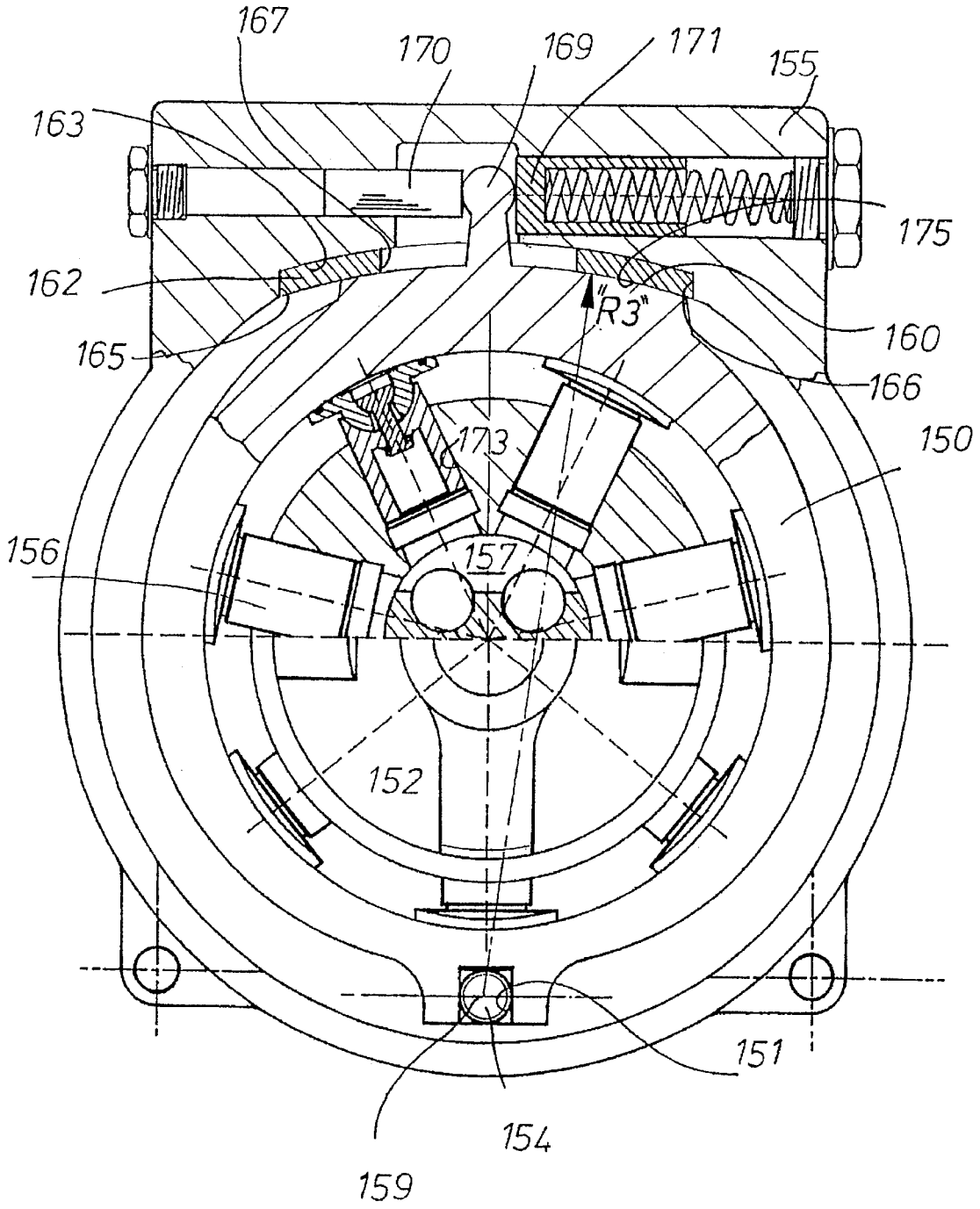
FIG. 4 is a sectional end view of the second embodiment of the invention.

In the second embodiment of the invention shown as FIG. 4, only those features that distinguish from the earlier embodiment will be described. Essentially, here the track-ring 150 is provided with an open-ended slot 151, the longitudinal axis of the slot 151 being arranged to be transverse to the rotational axis 152 of the machine 153. A pin 154 is fixed in both housing elements (only housing element 155 shown in this view) and provides the pivotal fulcrum or eccentric axis for the track-ring 150. Thereby radial movement of the track-ring 150 is a direction away from the pin 154 can occur when those pistons 156 fluidly connected to arcuate-slot 157 experience pressurized fluid. In effect, the slot 151 allows relative movement between the track-ring 150 and the pin 154.

A radius "R3" taken from the eccentric axis numbered 159 lying on the longitudinal axis of pin 154 defines the convex part-cylindrical shape of the bearing-surface 160 covering a portion of the total circumferential length of the track-ring 150.

Abutment-member 162 is placed in a recess 163 provided in housing element 156 so as to be restrained from movement by the walls 165, 166 of the recess 163. Although the abutment-member may be in two pieces, the abutment-member 162 as illustrated is in one piece and has a central aperture 167. A radially projection 169 formed on the track-ring 150 is arranged to protrude through aperture 167 to be operatively engaged by hydraulic-rams 170, 171.

Pressurized fluid in arcuate-slot 157 and cylinders 173 causes the pistons 156 to urge the bearing surface 160 of the track-ring 150 towards bearing surface 175 provided on the abutment-member 162.

Figure 5:
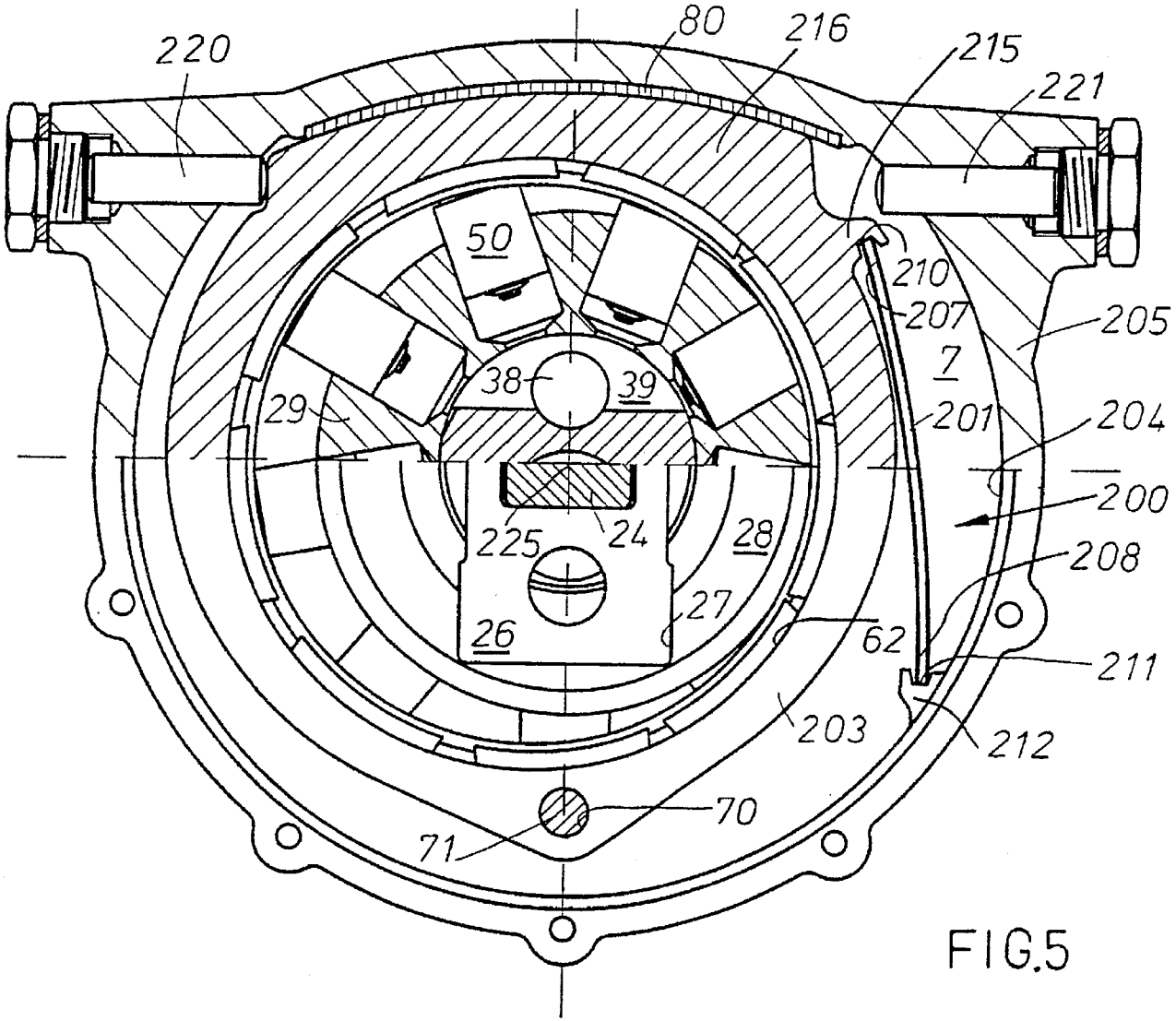
FIG. 5 is a sectional view of the third embodiment of the invention of a machine type shown as the first embodiment but where a strut-member is used in place of the hydraulic-rams. The strut member as shown in its partially deformed condition which corresponds to maximum eccentricity of the track-ring.
Figure 6:
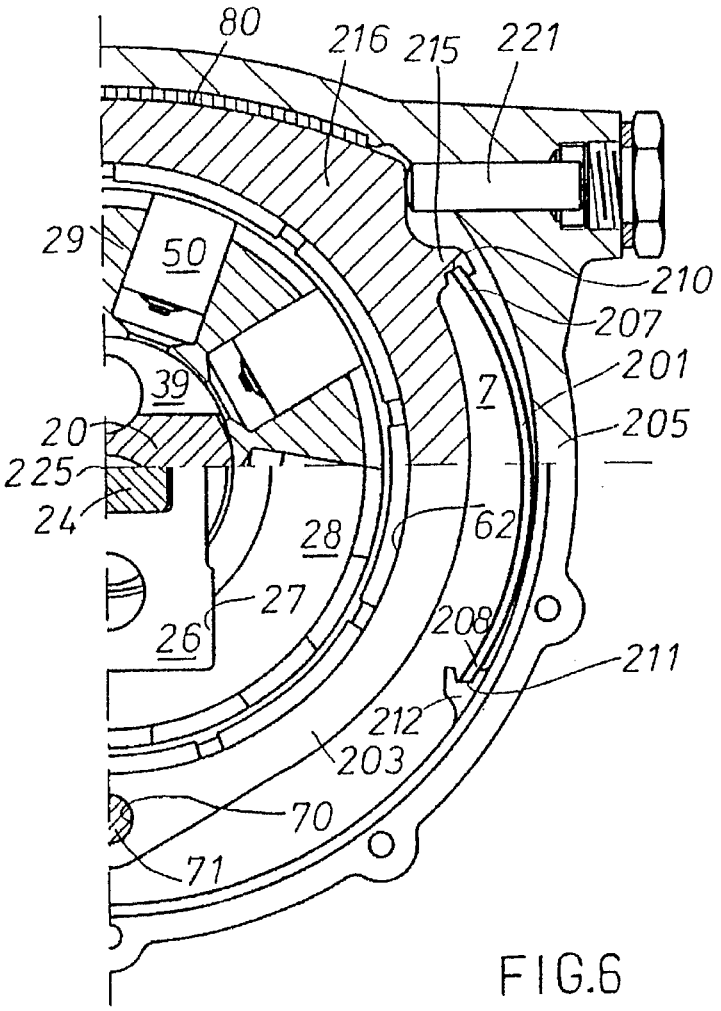
FIG. 6 shows the strut-member of FIG. 5 in its fully deformed condition which corresponds to minimum eccentricity for the track-ring.

In the third embodiment of the invention shown as FIGS. 5 & 6, mechanical adjustment means are used in place of the hydraulic-rams disclosed in the earlier embodiments. The mechanical adjustment means 200 comprises a strut-member 201 having one or more laminations, and is positioned to one side of track-ring 203 adjacent to a peripheral wall 204 of housing element 205.

Strut-member 201 is anchored at each end 207, 208 in respective grooves 210, 211. Groove 211 is provided in radially inwardly protruding shelf 212 attached to housing element 205, and groove 210 is provided in an radially outwardly extending protrusion 215 formed near the radially exterior portion 216 on track-ring 203. In terms of obtaining the best possible mechanical leverage and stable operation of strut-member 201, protrusion 215 should be formed on that side of the track-ring nearest the abutment-member 80.

End stops in the form of pins 220, 221 are provided in housing element 205 which determine the maximum amount of pivotal movement possible for the track-ring 203.

Strut-member 201 is disposed in the housing element 205 and has an initial partially deformed condition. Thereby track-ring 203 is held in an eccentric position relative to the rotational axis of the machine shown as point 225. During operation of the machine, when the forces created by those pistons 50 experiencing pressurized fluid reaches a level sufficient to cause further deformation of the strut-member 201, the eccentricity of the track-ring 203 reduces. When the strut-member 201 has reached its fully deformed condition as shown in FIG. 6, track-ring 203 is approximately concentric with the rotational axis of the machine shown as point 225. Once the pressure level in the machine falls, and forces produced by the pistons 50 on the track-ring 203 are insufficient to keep the strut-member 201 fully deformed, as a consequence the strut-member 201 reverts back to its initial partially deformed condition and the track-ring 203 returns towards full eccentricity as shown in FIG. 5. As abutment means 80 substantially reduces the amount of track-ring 203 vibration during machine operation, the strut-member 201 behaves in a stable manner and in combination with the abutment-member 80, provides an exceedingly simple and economic solution for a high-pressure hydrostatic piston machine.

A further advantage of all the embodiments here illustrated is that the axis along which the hydraulic rams act on the track-ring is "co-planer" and inline with the piston reaction forces. In other words, the action of the forces generated by the pressurized pistons and hydraulic-rams pass through the exact same plane in the abutment means, thereby eliminating any tendency for the hydraulic-rams to tilt the track-ring out from true alignment with the abutment means.

Figure 7:
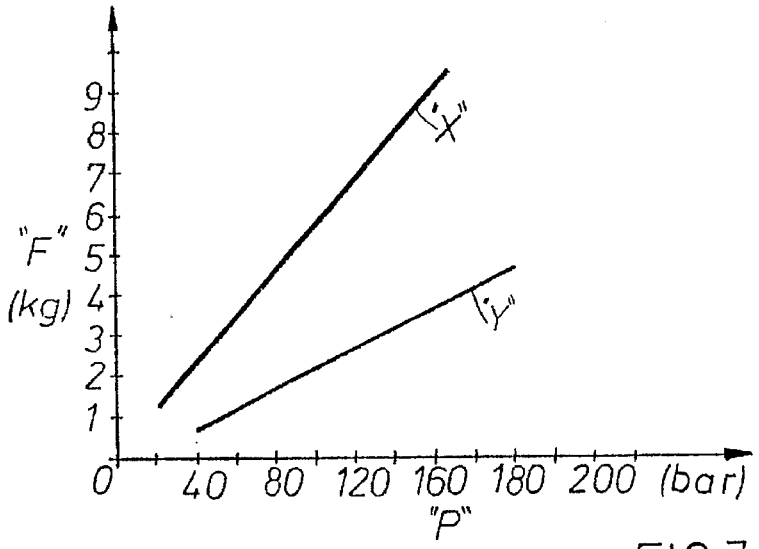
FIG. 7 is a graph of "F"—control force verses "p" system pressure, to show the comparative effort required to displace the track-ring of a prior art radial piston machine machine and one incorporating the features of the present invention.

FIG. 7 is a graph of control force "F" verses system pressure "p", and shows two slopes marked "X" and "Y".

Slope "X" shows the measured control force required to displace the track-ring of a conventional art radial piston machine employing a track-ring pivotally supported on a pivot-pin. Slope "Y" shows the measured control force required to displace the track-ring of a radial piston machine according to the present invention. For this comparison, the mechanical leverage for both track-rings was arranged to be the same. The difference in the two slopes "X" and "Y" shows a significant reduction in the applied force or effort required in a machine incorporating the features of the invention. As a result, the physical size of the actuation control elements for the track-ring can now be miniaturized.

We claim:

1. In a radial piston hydrostatic machine, a housing having a drive-shaft comprising: at least two housing elements connectable together along a parting-plane arranged perpendicular to the rotational axis of said drive-shaft to define an internal chamber, a cylinder-barrel disposed within said chamber and drivingly connected to said drive-shaft, said cylinder-barrel having a plurality of cylinders, a piston disposed within each of said cylinders, an annular track-ring surrounding said cylinder-barrel such that the pistons can bear on said track-ring and where said track-ring includes a radially outwardly extending exterior portion forming a convex part-cylindrical bearing surface, said track-ring being mounted for pivotal movement in a radial plane about an eccentric axis parallel to the axis of rotation of said drive-shaft, fixed abutment means in said housing and disposed radially adjacent said track-ring for resisting the action of said pistons on said track-ring.

2. A radial piston hydrostatic machine according to claim 1 wherein said abutment means comprises a concave part-cylindrical bearing surface to co-operate with said convex part-cylindrical bearing surface of said track-ring.

3. A radial piston hydrostatic machine according to claim 2 wherein a pintle-valve fixedly and non-rotatably mounted in said housing extends into said internal chamber to rotatably support said cylinder-barrel, a pair of arcuate-slots formed on the periphery of said pintle-valve and arranged to fluidly connect with said cylinders of said cylinder-barrel, and where said abutment means is located nearest to whichever one of said pair of arcuate-slots is distributing high-pressure fluid, the reaction of those said pistons experiencing high-pressure fluid in their respective said cylinders causing radial movement of said track-ring in a direction towards said abutment means.

4. A radial piston hydrostatic machine according to claim 3 wherein pivoting means are provided for said track-ring to allow its radial position to be varied relative to said pintle-valve in a direction generally transverse to that movement occurring between said track-ring and said abutment means.

5. A radial piston hydrostatic machine according to claim 2 wherein a hydraulic-ram or rams operate within respective bores provided in said housing and are engaged to respective ends of said radially outwardly extending exterior portion of said track-ring.

6. A radial piston hydrostatic machine according to claim 5 wherein each said hydraulic-ram or rams is dimensioned in terms of area to be not more that 49% the size of one of said pistons.

7. A radial piston hydrostatic machine according to claim 5 wherein said housing is provided with a fluid entry-passageway and a fluid exit-passageway, and wherein a feeder-passageway connects said fluid exit-passageway to said hydraulic-ram or rams.

8. A radial piston hydrostatic machine according to claim 7 wherein the longitudinal axis of said feeder-passageway lies in a plane set parallel to and behind the plane containing the longitudinal axis of said hydraulic-ram or rams.

9. A radial piston hydrostatic machine according to claim 8 wherein a cartridge-valve is disposed within said machine to receive fluid from said feeder-passageway.

10. A radial piston hydrostatic machine according to claim 9 wherein a relief-valve is disposed within said cartridge-valve.

11. A radial piston hydrostatic machine according to claim 10 wherein a throttle-valve is disposed within said feeder-passageway.

12. A radial piston hydrostatic machine according to claim 2 wherein a collapsible strut-member is included, said strut-member being held at one of its ends by said housing, the other end being held in proximity to said radially outwardly extending exterior portion of said track-ring.

13. A radial piston hydrostatic machine according to claim 12 wherein said track-ring is eccentrically positioned with respect to the rotational axis of said drive-shaft by means of said strut-member in a partially deformed condition, and where rising fluid pressure in said machine causes increased deformation of said strut-member with a corresponding decrease in the eccentricity of said track-ring.

14. A radial piston hydrostatic machine according to claim 2 wherein said housing is provided with one or more fluid passageways and where one of said housing elements is provided with a central aperture for carrying a bearing to support said drive-shaft, another of said housing elements being provided with a centrally located aperture tapered along its longitudinal axis to receive and support a corresponding tapered portion provided on the shanked end of said pintle-valve, said pintle-valve being fixedly held for axial position within said tapered aperture by resilient retaining means and extending into said internal chamber to support said cylinder-barrel, and where said pintle valve is provided with a circlip and thrust washer near its mid-point and positioned within said internal chamber to control the axial location of said cylinder-barrel in one direction, said drive-shaft controlling the axial location of said cylinder-barrel in the opposite direction.

15. A radial piston hydrostatic machine according to claim 14 wherein each of said pistons is connected to respective slippers, said slippers floating on a film of fluid on the annular surface of said annular track-ring, and where guidance-rings provided for the slippers which are held within grooves provided in said slippers, the grooves fixing the axial position of said rings within said internal chamber to prevent said rings and said slippers from contacting adjacent walls in said housing.

16. A radial piston hydrostatic machine according to claim 1 wherein a concave part-cylindrical bearing surface is formed on the interior of said housing to act as said abutment means, and where said convex part-cylindrical bearing surface of said track-ring co-operates with said concave part-cylindrical bearing surface.

17. A radial piston hydrostatic machine according to claim 16 wherein a pintle-valve fixedly and non-rotatably mounted in said housing extends into said internal chamber to rotatably support said cylinder-barrel, pivoting means are provided for said track-ring to allow its radial position to be varied relative to said pintle-valve in a direction generally transverse to that movement occurring between said track-ring and said abutment means, a pair of arcuate-slots formed on the periphery of said pintle-valve and arranged to fluidly connect with said cylinders of said cylinder-barrel, and where said concave part-cylindrical bearing surface is located nearest to whichever one of said pair of arcuate-slots is distributing high-pressure fluid, the reaction of those said pistons experiencing high-pressure fluid in their respective said cylinders causing radial movement of said track-ring in a direction towards said concave part-cylindrical bearing surface.

18. A radial piston hydrostatic machine according to claim 1 wherein the interior of said housing is provided with a recess into which said abutment means is retained, the housing-walls adjacent said recess restraining said abutment means from rotational movement.

19. A radial piston hydrostatic machine according to claim 1 wherein said abutment means comprises an abutment-member of part-cylindrical shape located within a concave part-cylindrical recess provided in the interior of said housing, the circumferentially spaced ends of said abutment-member lying adjacent to respective walls at either side of said recess to prevent rotational movement of said abutment-member.

20. A radial piston hydrostatic machine according to claim 1 wherein a spigot-projection is provided on said track-ring and extends past said abutment means to be operatively connected by one or more hydraulic rams.

21. A radial piston hydrostatic machine according to claim 1 wherein a hydraulic-ram or rams operate within respective bores provided in said housing to slide along an axis arranged perpendicular to said eccentric axis.

22. A radial piston hydrostatic machine according to claim 21 wherein the longitudinal axis along which said hydraulic-ram or rams lie is arranged to intersect the inner diameter of said annular track-ring.

23. A radial piston hydrostatic machine according to claim 21 wherein at least one guidance-slot is provide in said housing or said track-ring, said guidance-slot positioned on diametrically opposite sides of the said rotation axis of said drive-shaft where said abutment means lies, a pin disposed within said machine and relative movement between said pin and said guidance-slot occurring when said pistons experiencing high-pressure act to cause said track-ring to move towards said abutment means.

24. A radial piston hydrostatic machine according to claim 1 wherein said at least two housing elements are aligned together on a circular register, and where said abutment means is substantially located to lie inside said circular register.

25. In a radial piston hydrostatic machine, a housing having a drive-shaft comprising: at least two housing-elements connectable together along a parting-plane arranged perpendicular to the rotational axis of said drive-shaft to define an internal chamber, a cylinder-barrel disposed within said chamber and drivingly connected to said drive-shaft, said cylinder-barrel having a plurality of cylinders, a piston disposed within each of said cylinders, an annular track-ring surrounding said cylinder-barrel such that the pistons bear on said track-ring, said track-ring being mounted for pivotal movement in a radial plane about an eccentric axis parallel to the axis of the rotation of said drive-shaft, and abutment-surfaces for controlling contact between said annular track-ring and the interior of said housing, said abutment-surfaces comprising a concave first part-cylindrical bearing surface on the interior of said housing, and a complementary convex second part-cylindrical bearing surface on a radially outwardly extending exterior portion of said track-ring, said first and second bearing surface describing cylinders having a common axis coincident with said eccentric axis, and where hydraulic-ram or rams for causing said pivotal movement are provided in said housing to engage with either one or both opposing ends of said radially outwardly extending exterior portion of said track-ring, the longitudinal axis of sliding movement of said hydraulic-ram or rams is arranged to intersect the inner diameter of said annular track-ring.

26. In a radial piston hydrostatic machine, a housing having a drive-shaft comprising: at least two housing-elements connectable together along a parting-plane arranged perpendicular to the rotational axis of said drive-shaft to define an internal chamber, a cylinder-barrel disposed within said chamber and drivingly connected to said drive-shaft, said cylinder-barrel having a plurality of cylinders, a piston disposed within each of said cylinders, an annular track-ring surrounding said cylinder-barrel such that the pistons bear on said track-ring, said track-ring being mounted for pivotal movement in a radial plane about an eccentric axis parallel to the axis of the rotation of said drive-shaft, fixed abutment means in said housing and disposed radially adjacent said track-ring for resisting said action of the pistons on said track-ring, a pintle-valve fixedly and non-rotatably mounted in said housing and extending into said internal chamber to rotatably support said cylinder-barrel, a pair of arcuate-slots formed on the periphery of said pintle-valve and arranged to fluidly connect with said cylinders of said cylinder-barrel so that one of said pair of arcuate-ports distributing high-pressure fluid is positioned to be closest to said abutment means, said track-ring being provided with a radially outwardly extending exterior portion on that side of the axis of rotation of said drive-shaft diametrically opposite said eccentric axis, opposite ends of a collapsible strut-member being connected to said housing and in proximity of said radially outwardly extending exterior portion of said track-ring respectively, and where said track-ring is eccentrically positioned with respect to the rotational axis of said drive-shaft by means of said strut-member in a partially deformed condition, and where rising fluid pressure in said machine causes increased deformation of said strut-member with a corresponding decrease in the eccentricity of said track-ring.

27. In a radial piston hydrostatic machine according to claim 26 wherein the reaction of those said pistons experiencing high-pressure fluid in their respective said cylinders cause radial movement of said track-ring in a direction towards said abutment means.

28. In a radial piston hydrostatic machine comprising a housing defining an internal chamber; a drive-shaft supported in said housing; a cylinder-barrel disposed within said chamber and drivingly connected to said drive-shaft to have common axis of rotation, said cylinder-barrel having a plurality of cylinders; a piston disposed within each of said cylinders and operatively connected to a surrounding annular track-ring; said track-ring positioned within said chamber with sufficient radial clearance to be able to be moved into an eccentric relationship relative to said cylinder-barrel to effect reciprocation of the pistons as well as having freedom for movement in a direction transverse to such eccentric movement whereby such transverse movement of said track-ring is caused by the reaction of those said pistons which at any one instance in the operational cycle are experiencing high-pressure fluid in their respective said cylinders; a radially outwardly extending integral exterior portion provided on said track-ring to form a bearing-surface; abutment means in said housing and disposed radially adjacent said bearing surface for resisting the action of said pistons experiencing high-pressure fluid urging said track-ring to move in the direction towards said abutment means.

29. A radial piston hydrostatic piston machine according to claim 28 including pintle-valve or equivalent fluid distribution means provided with a pair of arcuate-slots arranged to fluidly connect with said cylinders of said cylinder-barrel so that one of said pair of arcuate-slots distributing high-pressure fluid is positioned to be closest to said abutment means.

30. A radial piston hydrostatic piston machine according to claim 28 wherein opposite ends of a collapsible strut-member are connected to said housing and in proximity of said bearing surface respectively; when said strut-member is in a partially deformed condition, said track-ring is placed in eccentric relationship relative to said cylinder-barrel; and where rising fluid pressure in said machine causis increased deformation of said strut-member and a corresponding decrease in the eccentric relationship of said tracking relative to said cylinder-barrel.

* * * * *